US005967943A

United States Patent [19]

Rich

[11] Patent Number: 5,967,943

[45] Date of Patent: Oct. 19, 1999

[54] TRAMPOLINE WITH ELASTIC FRAME ATTACHMENT SYSTEM

[76] Inventor: Rolland Wayne Rich, 3513 Gillionville Rd., Albany, Ga. 31707

[21] Appl. No.: 09/013,469

[22] Filed: Jan. 26, 1998

Related U.S. Application Data

[60] Provisional application No. 60/066,657, Nov. 26, 1997.

[51] Int. Cl.[6] ..... A63B 5/11

[52] U.S. Cl. ..... 482/27; 182/37

[58] Field of Search ..... 482/23, 26–29, 482/74, 121–123; 182/137–140; 473/434, 435; D21/672, 686, 692

[56] References Cited

U.S. PATENT DOCUMENTS

| | | | |
|---|---|---|---|
| 728,204 | 5/1903 | Coffman . | |
| 920,680 | 5/1909 | Southwick . | |
| 2,652,966 | 9/1953 | Griswold | 482/27 |
| 2,916,746 | 12/1959 | Pease | 482/27 |
| 2,991,841 | 7/1961 | Sampson et al. | 482/27 |
| 3,233,895 | 2/1966 | Grelle et al. . | |
| 3,734,496 | 5/1973 | Rubin | 482/27 |
| 3,767,009 | 10/1973 | Sidlinger | 482/27 |
| 3,767,192 | 10/1973 | Eriksson | 482/27 |
| 3,891,208 | 6/1975 | Sidlinger . | |
| 3,948,515 | 4/1976 | McNeil | 482/27 |
| 3,983,585 | 10/1976 | Sidlinger | 482/27 |
| 4,284,271 | 8/1981 | Pettit et al. . | |
| 4,331,329 | 5/1982 | Mirkovich et al. | 482/27 |
| 4,386,772 | 6/1983 | Wu . | |
| 4,576,375 | 3/1986 | Roberts . | |
| 5,299,989 | 4/1994 | Boyd et al. . | |
| 5,374,225 | 12/1994 | Wilkinson . | |

FOREIGN PATENT DOCUMENTS

| | | | |
|---|---|---|---|
| 256293 | 12/1964 | Australia | 482/27 |
| 2252920 | 8/1992 | United Kingdom | 482/27 |

*Primary Examiner*—Glenn E. Richmond

*Attorney, Agent, or Firm*—Finnegan, Henderson, Farabow, Garrett & Dunner, L.L.P.

[57] ABSTRACT

A trampoline including a trampoline mat, a frame surrounding the trampoline mat, and an attachment system for connecting the frame to the trampoline mat. The attachment system includes a plurality of elastic straps connected to the periphery of the trampoline mat and a plurality of connectors for connecting the elastic straps to the frame.

23 Claims, 5 Drawing Sheets

TRAMPOLINE WITH ELASTIC FRAME ATTACHMENT SYSTEM

This application claims the right to priority based on U.S. Provisional Patent Application Ser. No. 60/066,657 filed Nov. 26, 1997.

BACKGROUND OF THE INVENTION

1. Field of the Invention

The present invention relates to trampolines. More particularly, the present invention relates to an attachment system for connecting a trampoline mat to a trampoline frame.

2. Description of the Related Art

Trampolines and other springboards have been used for decades for sport, entertainment, and fitness purposes. Significant health risks, however, accompany the use of a trampoline. For instance, should the user lose control, he or she may land incorrectly on the trampoline or, even worse, fall off the trampoline causing significant injuries.

A conventional trampoline includes a central mat connected to an outer frame by a plurality of springs having open hooks at their ends. The springs hook into slots or holes at the top of the frame and connect to the mat at the opposite end. This construction leaves large spaces between adjacent springs. Often, the trampoline may include a foam pad covering the frame and loosely attached to the frame with string. The pad typically vibrates and moves during use and leaves these large spaces uncovered or only partially covered with only a thin foam pad. Should the user lose control, he or she may fall into these spaces and be injured.

SUMMARY OF THE INVENTION

Objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the inventive trampoline includes a trampoline mat, a frame surrounding the trampoline mat, and an attachment system for connecting the frame to the trampoline mat. The attachment system includes a plurality of elastic straps connected to the periphery of the trampoline mat and a plurality of connectors for connecting the elastic straps to the frame. The inventive trampoline therefore incorporates the mat, the elastic mechanism, and the frame into an integral construction.

According to another aspect of the invention, a trampoline includes a trampoline mat, a frame surrounding the trampoline mat, an elastic portion connected to a periphery of the trampoline mat and extending between the trampoline mat and the frame to cover substantially all of a space between the trampoline mat and the frame, and at least one connector for connecting the elastic portion to the frame.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention.

DESCRIPTION OF THE PREFERRED EMBODIMENTS

Reference will now be made in detail to the present preferred embodiments of the invention, examples of which are illustrated in the accompanying drawings.

The present invention is directed towards a trampoline having a mat, a frame, and an attachment system that connects the mat to the frame. The inventive trampoline may further include a frame protection system including a foam covering and a weather cover fixedly secured to the trampoline mat and frame. The trampoline attachment system consists primarily of elastic straps fixedly attached to the periphery of the mat and wire connectors for connecting the straps to the frame. Preferably, the trampoline includes a sufficient amount of elastic straps so that no spaces exist between the mat and the frame, as will be described further herein. In this way, a user that loses control will not fall between the mat and the frame. In addition, the construction to be described is lighter weight and easier to manufacture and transport than conventional trampolines.

Figure 1:
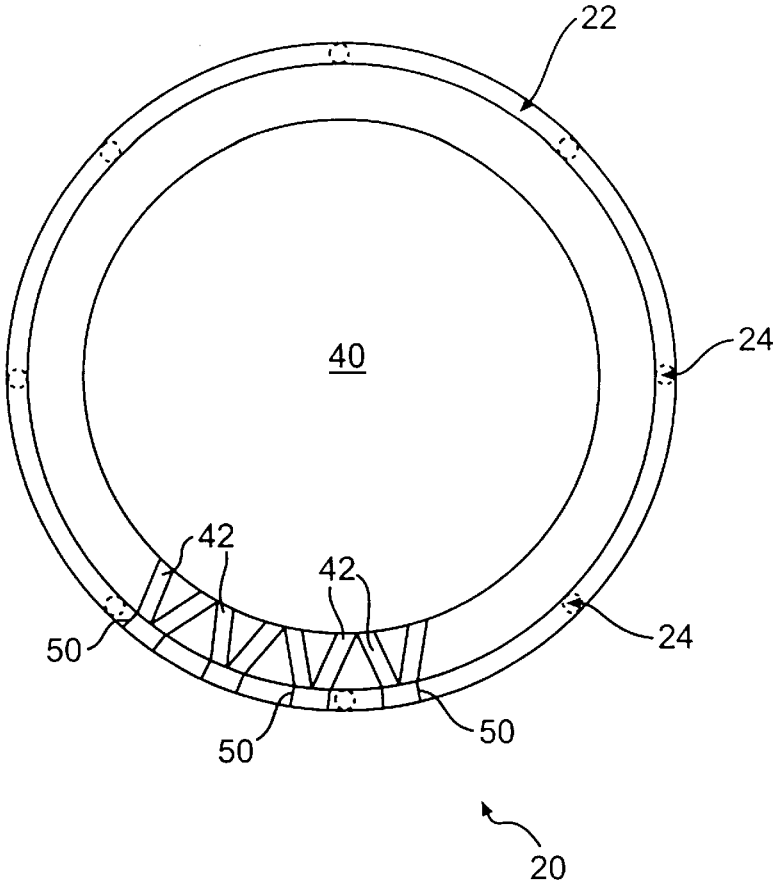
FIG. 1 is a top view of a trampoline according to a first embodiment of the present invention.
Figure 2:
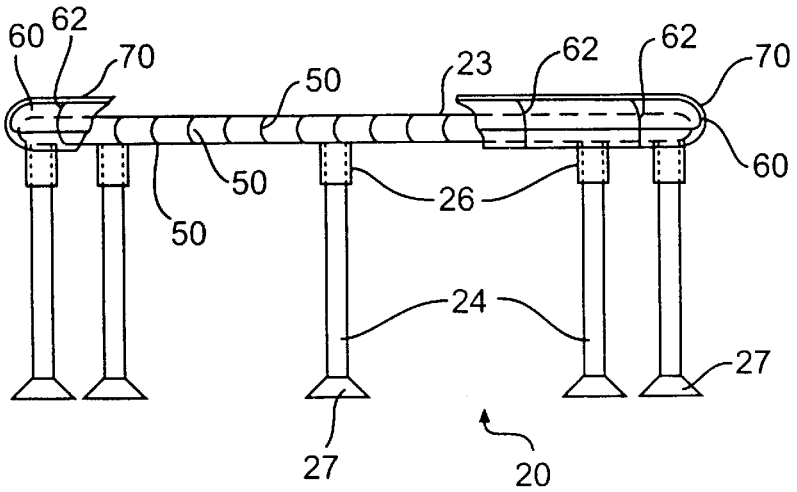
FIG. 2 is a side view of the trampoline of FIG. 1.

According to a first embodiment of the present invention, a trampoline 20 is shown in FIGS. 1 and 2. Trampoline 20 includes a mat 40 secured to a frame 22 by an attachment system to be described. Frame 22 generally includes a top portion 23 and a plurality of legs 24 supporting top portion 23. Top portion 23 may be comprised of a plurality of individual frame pieces, such as frame piece 28 shown in FIG. 6. Each frame piece 28 is preferably of an approximately oval cross-section with a substantially flat top portion, a substantially flat bottom portion, and outer and inner sides. Frame pieces of other cross-sectional shapes (i.e. substantially round, square, etc.) are within the scope of the present invention. Each individual frame piece 28 preferably includes a swedged end 30 to telescope into a corresponding open end of an adjacent frame piece 28. This type of connection provides a sturdy frame that does not rotate and a frame that is easy to assemble and disassemble. In addition, the use of a plurality of frame pieces allows for a trampoline that is easy to manufacture and transport.

Top portion 23 may be comprised of any suitable number of frame pieces 28 that, once connected together, form a shape that conforms to the shape of mat 40. In the embodiment shown in FIGS. 1 and 2, top portion 23 is of a circular shape. Top portion 23, however, may be square, octagonal, rectangular, or any other suitable size or shape.

Frame pieces 28 are preferably oval tubing having a thickness of approximately one inch and a width of approximately three inches. Some or all of frame pieces 28 include one or more leg sockets 26, as shown in FIG. 2. Each leg socket 26 accepts a leg 24. Leg sockets 26 are preferably tubing having a diameter of approximately two inches and a length of approximately four inches. Sockets 26 are preferably welded or otherwise fixedly secured to frame pieces 28. Legs 24 are preferably tubing of slightly less than two inches in diameter to telescope into leg sockets 26. Legs 24 may be formed to any suitable length so that trampoline 20 is at a desired height above the ground. Each leg 24 terminates in a leg support 27 that rests on the ground or floor. Leg supports 27 accept a bottom end of legs 24 and may be integrally formed with legs 24. Frame pieces 28, leg sockets 26, legs 24, and leg supports 27 are preferably manufactured of a high strength metal or other suitable material of sufficient strength.

Figure 3:
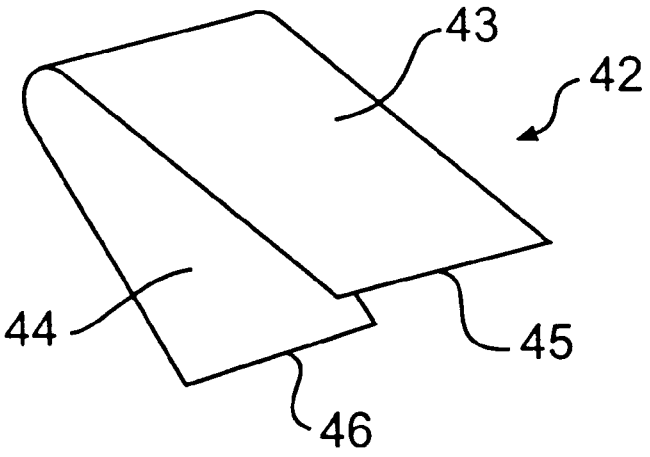
FIG. 3 is a perspective view of an embodiment of an elastic strap for use in a trampoline according to the present invention.
Figure 4:
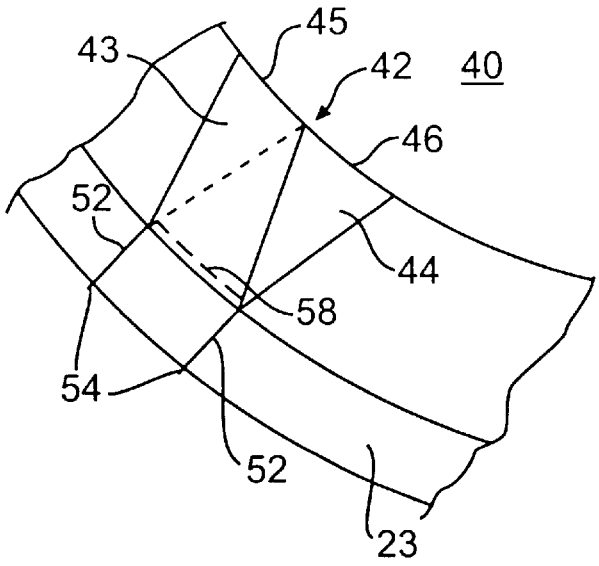
FIG. 4 is a an enlarged top view of a portion of the trampoline of FIG. 1.

Mat 40 may be a conventional trampoline mat made of polypropylene or other suitable material. Mat 40 attaches to frame 22 by an attachment system that includes a plurality of elastic straps 42, as shown in FIGS. 1 and 4. FIG. 1 shows only some of the plurality of elastic straps 42 that are used to attach mat 40 to frame 22. It is to be understood that elastic straps 42 surround the entire periphery of mat 40 to connect to frame 22. FIG. 4 shows an enlarged view of a single elastic strap 42 and its connection to mat 40 and top frame portion 23. With reference to FIGS. 3 and 4, each elastic strap 42 includes a top portion 43 which loops around to a bottom portion 44. Strap 42 also includes a top end 45 and a bottom end 46. Ends 45 and 46 are preferably sewn to the outer periphery of mat 40. Other means of fixedly connecting ends 45 and 46 to mat 40, or integrally forming mat 40 with straps 42, are within the scope of this invention. Strap 42 is manufactured from a woven elastic material that is elastically deformable (stretchable) so as to return to its original size and shape after deformation. The material of strap 42 is of a sufficient strength, however, to resist overstretching upon the application of large loads. A preferable material of strap 42 is a polypropylene woven elastic. Other suitable materials include woven nylon, rayon, or other like stretchable material. It is also important that such materials have a high resistance to ultraviolet rays.

It is to be understood that any suitable number of elastic straps 42 may be used around the periphery of mat 40 to connect mat 40 to frame 22. In a preferred embodiment, a sufficient number of straps 42 are used so that no spaces exist between mat 40 and frame 22. This increases the safety of the trampoline as a user cannot fall between the mat and the frame. Each elastic strap 42 is preferably of a width that corresponds to the wire connectors to be described herein. In a most preferred embodiment, each strap 42 is approximately three inches in width. Each strap 42 has a length that is approximately two times the desired separation between mat 40 and frame portion 23 so that strap 42 can be folded over.

Figure 5:
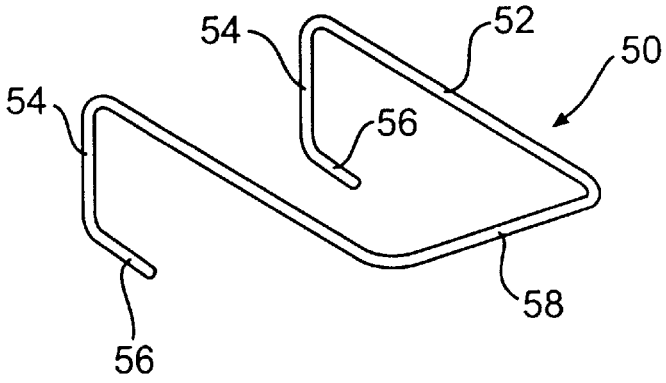
FIG. 5 is a perspective view of an embodiment of a connector for use in the trampoline of FIG. 1.
Figure 6:
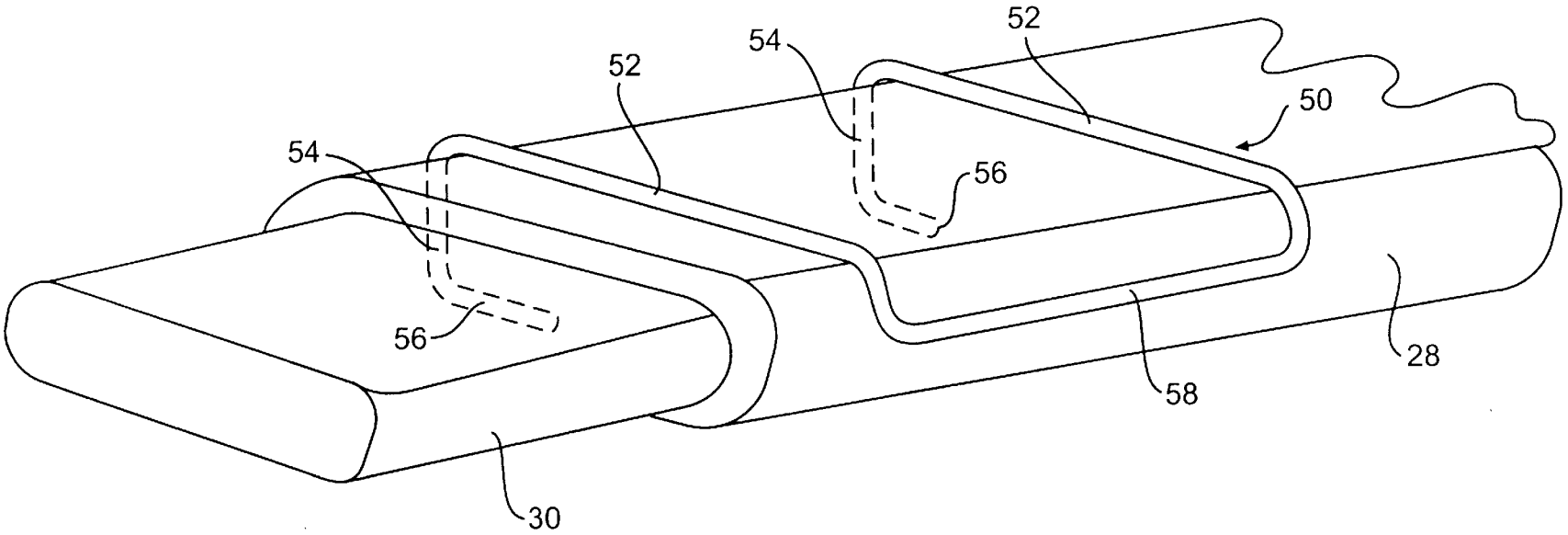
FIG. 6 is a perspective view of an embodiment of a frame piece and connector for use in a trampoline according to the present invention.

The attachment system for connecting mat 40 to frame 22 further includes a plurality of wire connectors, such as a wire connector 50 shown in FIG. 5. The wire connectors may be formed to fit any configuration or size tubing used in a trampoline frame. The wire connectors 50 of FIG. 5 connect elastic straps 42 to top portion 23 of frame 22. Prior to or after sewing or otherwise connecting both of the top and bottom ends 45 and 46 of strap 42 to mat 40, a wire connector 50 is inserted within the loop portion of strap 42. In particular, a front bar 58 of wire connector 50 may be inserted within the loop portion of strap 42 after sewing ends 45 and 46 onto the periphery of mat 40. Wire connector 50 includes top arms 52 that engage a flat top portion of frame pieces 28, as shown in FIG. 6. Wire connector 50 also includes side arms 54 that engage the outer sides of frame pieces 28, and bottom arms 56 that engage a flat bottom portion of frame pieces 28. Front bar 58 may be folded down, as shown in FIG. 6, to engage the inner side portions of frame pieces 28 for additional strength, or may be kept unbent with respect to top arms 52, as shown in FIG. 5. Wire connectors 50 are preferably constructed of heavy wire of a suitable high strength metal or other high strength material, such as molded plastic or aluminum.

Figure 2A:
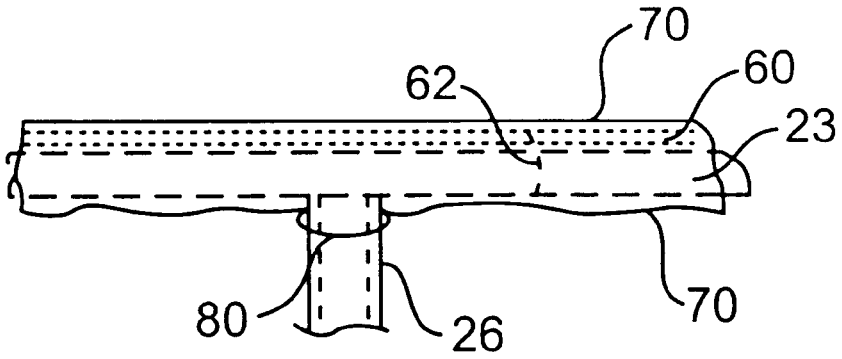
FIG. 2A is an enlarged partial side view of the trampoline of FIG. 1.

As shown in FIGS. 2 and 2A, a protective foam piece 60 overlies the top of frame portion 23 and is secured to frame portion 23 with ties 62, such as string or other suitable material, for added protection to the user. Foam piece 60 is preferably one inch thick by three inches wide to cover the entire width of frame portion 23.

In a preferred embodiment, trampoline 20 may include a weather cover 70, shown in FIGS. 2 and 2A, sewn or otherwise fixedly connected to the outer perimeter of mat 40 at the same location that straps 42 are connected to mat 40. Weather cover 70 overlaps straps 42 and foam piece 60 and folds over frame portion 23. Weather cover 70 is then connected to leg sockets 26 via BUNGEE-type cords, such as cords 80, that stretch during use. Cords 80 may be secured to an edge of cover 70 and looped around a leg socket 26. Weather cover 70 is preferably a three-ply laminated vinyl material or any other suitable material to protect foam piece 60 and elastic straps 42 from environmental elements. Weather cover 70 also provides additional protection to the user by covering any space between mat 40 and the frame portion 23.

The above-described trampoline, including the mat, elastic straps, connectors, and weather cover, provides a safe connection system of integral construction that can be retrofitted to existing trampoline frames of any size.

Figure 7:
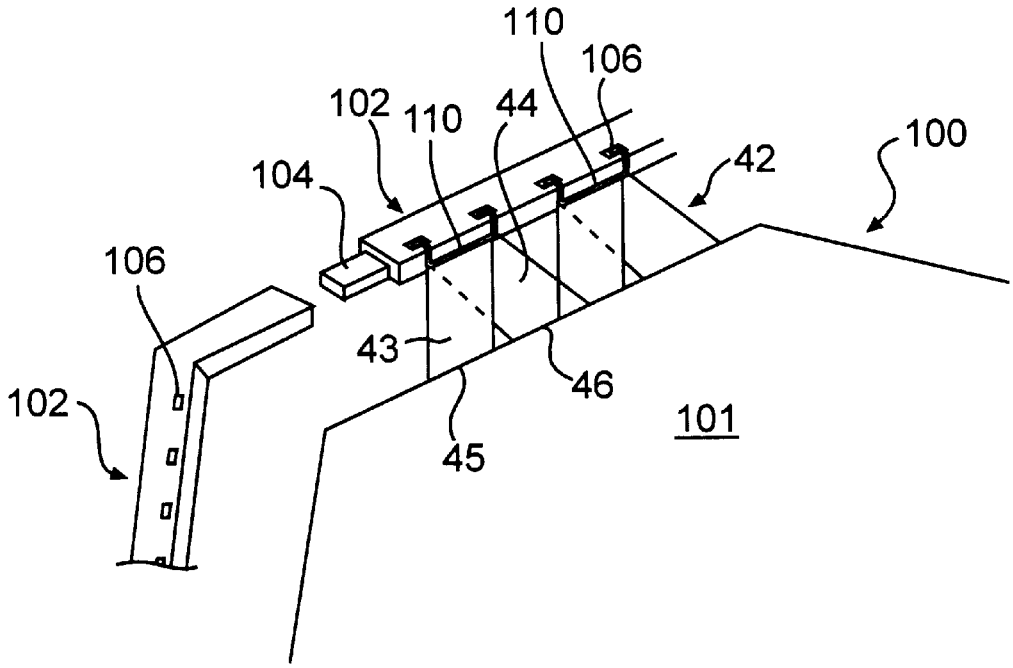
FIG. 7 is a partial perspective view of a trampoline according to a second embodiment of the present invention.
Figure 8:
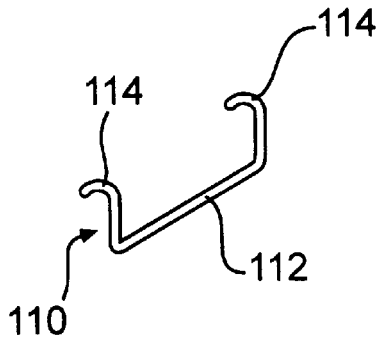
FIG. 8 is a perspective view of an embodiment of a connector for use in the trampoline of FIG. 7.

FIG. 7 shows a second embodiment of a trampoline according to the present invention and generally denoted by reference numeral 100. Trampoline 100 includes a trampoline mat 101 of an octagonal shape. As in the previous embodiment, trampoline mat 101 can be of any desired shape.

Trampoline 100 further includes a frame having a plurality of individual frame pieces 102 that connect to form a top frame portion, similar to that described in the first embodiment. Each frame piece 102 includes a swedged end 104 to telescope into an open end of an adjacent frame piece 102. Once connected, frame pieces 102 form an octagonal shaped frame corresponding to the shape of trampoline mat 101. Some or all of frame pieces 102 include leg sockets (not shown) that accept legs (not shown), as described in connection with the embodiment of FIGS. 1 and 2.

The attachment system for connecting frame piece 102 to mat 101 includes the same elastic straps 42 described in connection with the embodiment of FIGS. 1 to 6. The attachment system of the embodiment shown in FIG. 7, however, uses a wire connector 110 of a different configuration than that of wire connector 50 used in the previous embodiment. Wire connector 110 includes a front bar 112 that is positioned within the loop of strap 42 and engages an inner side portion of frame pieces 102. Wire connector 110 further includes side hooks 114 that engage slots 106 in the top of frame pieces 102, as shown in FIG. 7. In the alternative to wire connector 110, a metal pin may be placed through the loop of straps 42, and an S shaped hook can be connected to both ends of the pin and placed into slots 106 of frame pieces 102.

Once frame pieces 102 are connected to trampoline mat 101, a foam piece can be positioned over and attached to frame pieces 102 in a similar manner as described earlier, and a weather cover can be attached to trampoline mat 101 and the frame of trampoline 100 also as discussed earlier.

It also will be apparent to those skilled in the art that various modifications and variations can be made in the trampolines of the present invention and in construction of the trampolines without departing from the scope or spirit of the invention. As an example, the trampoline mat elastic straps, and/or weather cover may be manufactured of a single one-piece construction with the wire connectors within the loops of the straps.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A trampoline comprising:

a trampoline mat;

a frame surrounding the trampoline mat; and an attachment system for connecting the frame to the trampoline mat, the attachment system including a plurality of elastic straps connected to a periphery of the trampoline mat and a plurality of connectors for connecting the elastic straps to the frame, wherein each connector has a shape corresponding to the shape of the frame, said shape to shape correspondence providing a connection between the connector and the frame, and wherein the plurality of elastic straps cover substantially all of a space between the trampoline mat and the frame.

2. The trampoline of claim 1, wherein each of the plurality of elastic straps defines a loop portion therein for accepting a connector.

3. The trampoline of claim 1, wherein each of the plurality of elastic straps includes a top portion having a top end and a bottom portion having a bottom end.

4. The trampoline of claim 3, wherein the top portion and bottom portion define a loop portion of the elastic strap for accepting a connector.

5. The trampoline of claim 3, wherein the top end and the bottom end connect to the periphery of the trampoline mat.

6. The trampoline of claim 1, wherein each of the plurality of connectors comprises a wire.

7. The trampoline of claim 6, wherein each of the plurality of connectors includes at least one top arm for engaging a top portion of the frame.

8. The trampoline of claim 6, wherein each of the plurality of connectors includes at least one side arm for engaging a side portion of the frame.

9. The trampoline of claim 1, wherein each of the plurality of connectors includes a wire bar for insertion into a loop portion of one of the plurality of elastic straps.

10. The trampoline of claim 1, wherein each of the plurality of connectors includes at least one hooked portion for engaging a slot in the frame.

11. The trampoline of claim 1, wherein each of the plurality of connectors includes a pair of hooks.

12. The trampoline of claim 1, further comprising a foam piece overlying the frame.

13. The trampoline of claim 1, further comprising a cover connected to the periphery of the mat and overlying the plurality of elastic straps.

14. The trampoline of claim 1, wherein the frame includes a plurality of interconnected frame pieces.

15. The trampoline of claim 14, wherein each of the plurality of frame pieces includes a swedged end to telescope into an open end of an adjacent frame piece.

16. A trampoline attachment system for connecting a trampoline mat to a surrounding frame, the attachment system comprising:

a plurality of elastic straps connected to a periphery of the trampoline mat; and a plurality of connectors for connecting the elastic straps to the frame, wherein each connector has a shape corresponding to the shape of the frame, said shape to shape correspondence providing a connection between the connector and the frame, and wherein the plurality of elastic straps cover substantially all of a space between the trampoline mat and the frame.

17. The trampoline attachment system of claim 16, further comprising a weather cover connected to the periphery of the trampoline mat.

18. A trampoline comprising:

a trampoline mat;

a frame surrounding the trampoline mat;

an elastic portion connected to a periphery of the trampoline mat and extending between the trampoline mat and the frame to cover substantially all of a space between the trampoline mat and the frame; and at least one connector for connecting the elastic portion to the frame, wherein the at least one connector has a shape corresponding to the shape of the frame, said shape to shape correspondence providing a connection between the at least one connector and the frame.

19. The trampoline of claim 18, wherein the elastic portion includes a plurality of elastic straps and the at least one connector includes a plurality of connectors.

20. A trampoline comprising:

a trampoline mat;

a frame surrounding the trampoline mat; and an attachment system for connecting the frame to the trampoline mat, the attachment system including a plurality of elastic straps connected to a periphery of the trampoline mat and a plurality of connectors for connecting the elastic straps to the frame, wherein each connector comprises a single wire which has a shape corresponding to the shape of the frame, the single wire having a front bar for receiving a loop portion of one of the plurality of elastic straps, and an arm portion on each side of the front bar for engaging with a surface of the frame.

21. The trampoline of claim 20, wherein the arm portions of each connector engage the surface of the frame to securely hold the connector to the frame without a separate fastener.

22. The trampoline of claim 21, wherein each arm portion comprises a top arm for engaging a top portion of the frame, and a side arm for engaging a side portion of the frame.

23. The trampoline of claim 21, wherein each arm portion comprises a hooked portion for engaging a slot in the frame.

* * * * *